United States Patent [19]

Cohen

[11] Patent Number: 4,756,394

[45] Date of Patent: Jul. 12, 1988

[54] EXPANDABLE HAND LUGGAGE WITH WHEELS AND SEPARABLE COMPARTMENTS

[76] Inventor: Fred E. Cohen, 2201 Banyon Dr., Los Angeles, Calif. 90049

[21] Appl. No.: 931,346

[22] Filed: Nov. 17, 1986

Related U.S. Application Data

[63] Continuation-in-part of Ser. No. 855,933, Apr. 25, 1986, abandoned.

[51] Int. Cl.[4] ..... A45C 3/00; A45C 5/14; A45C 7/00; A45C 13/10

[52] U.S. Cl. ..... 190/18 A; 190/103; 190/107; 190/108; 190/110; 190/112; 190/116; 190/903; 150/111; 383/2; 383/37

[58] Field of Search ..... 190/18 A, 108, 109, 190/110, 115, 103, 107; 383/2, 37; 150/111; D3/71

[56] References Cited

U.S. PATENT DOCUMENTS

| | | | |
|---|---|---|---|
| Re. 25,826 | 8/1965 | Ward | 190/109 X |
| D. 248,794 | 8/1978 | Cooper | D3/71 |
| 930,032 | 8/1909 | Billburg et al. | 190/108 |
| 2,372,845 | 4/1945 | Nelson | 190/108 |
| 2,721,596 | 10/1955 | Danneil | 383/2 X |
| 3,061,057 | 10/1962 | Miller | 190/110 |
| 3,410,376 | 11/1968 | Benzel | 190/109 X |
| 3,696,850 | 10/1972 | Rosenblum | 190/108 |
| 3,830,348 | 8/1974 | Ohyama | 383/2 X |
| 3,989,080 | 11/1976 | Koszegi | 383/2 X |
| 4,081,061 | 3/1978 | Tucker | 190/108 |
| 4,361,215 | 11/1982 | Sawai | 190/103 X |
| 4,422,212 | 12/1983 | Sheiman et al. | 190/18 A X |
| 4,436,189 | 3/1984 | Baum | 190/108 |
| 4,442,960 | 4/1984 | Vetter | 190/108 X |
| 4,506,769 | 3/1985 | Franco et al. | 190/108 |
| 4,545,414 | 10/1985 | Baum | 190/115 X |

FOREIGN PATENT DOCUMENTS

| | | | |
|---|---|---|---|
| 2359229 | 6/1975 | Fed. Rep. of Germany | 190/18 A |
| 1562995 | 4/1969 | France | 190/108 |
| 2573635 | 5/1986 | France | 190/103 |
| 83885 | 8/1954 | Norway | 190/115 |
| 2018580 | 10/1979 | United Kingdom | 190/103 |
| 2022997 | 12/1979 | United Kingdom | 190/18 A |

*Primary Examiner*—William Price
*Assistant Examiner*—Sue A. Weaver
*Attorney, Agent, or Firm*—Keith D. Beecher

[57] ABSTRACT

Expandable luggage which includes a case forming a first compartment and having a hinged cover, and a collapsible bag located at the top of the case and forming a second compartment to provide additional packing space when required. A removable panel is also attached to the top of the case, and the panel forms a pocket for the collapsible bag when the second compartment is not in use.

8 Claims, 3 Drawing Sheets

EXPANDABLE HAND LUGGAGE WITH WHEELS AND SEPARABLE COMPARTMENTS

This application is a continuation-in-part of Copending Application Ser. No. 855,933, which was filed Apr. 25, 1986, abandoned in the name of the present inventor.

BACKGROUND OF THE INVENTION

The principal objective of the invention is to provide expandable luggage comprising a case forming a first compartment and which may be expanded to include a second compartment in the form of a collapsible bag when additional packing space is required.

DETAILED DESCRIPTION OF THE ILLUSTRATED EMBODIMENT

Figure 2:
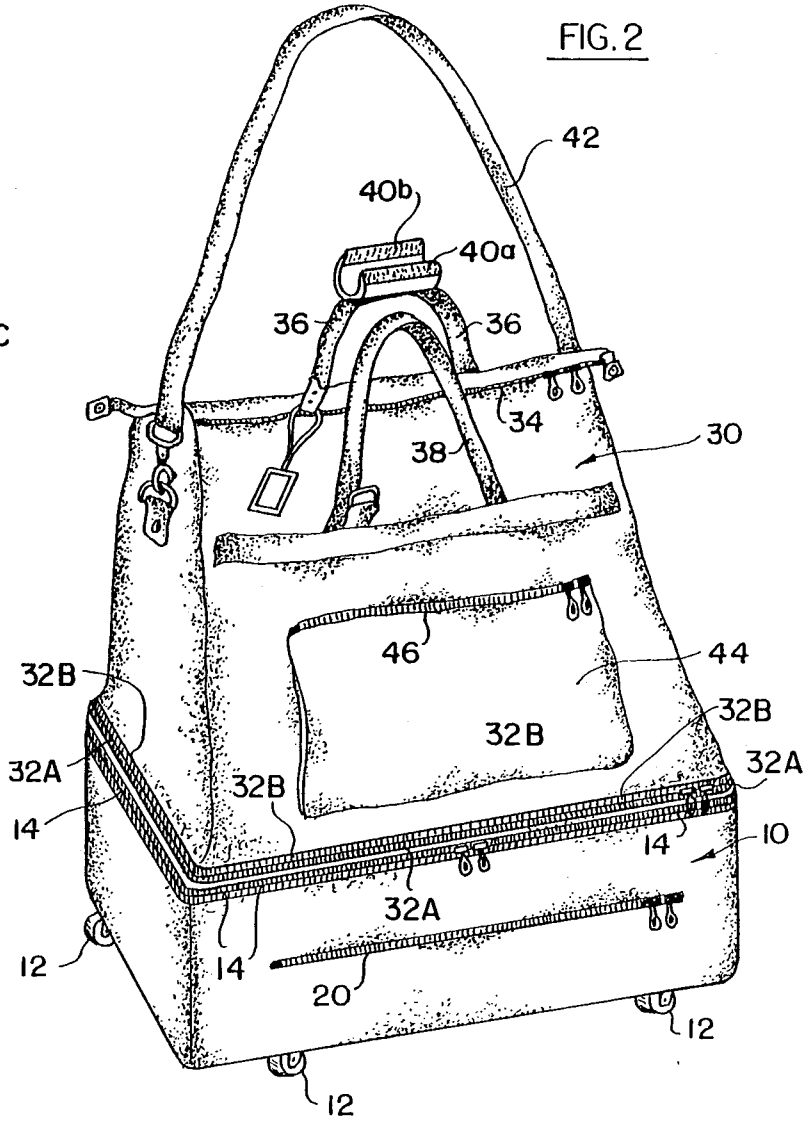
FIG. 2 is a perspective representation of the expandable luggage of FIG. 1, with both the case and the collapsible bag in use.

The expandable luggage shown in the drawings includes a generally rectangular case 10 having a generally rigid construction, and preferably covered by an appropriate fabric material. Case 10 is supported on appropriate wheels 12, so that the hand luggage may be easily transported, for example, by pulling a strap 54 which is attached to a ring 55 at one end of the case by buckles 56.

Figure 5:
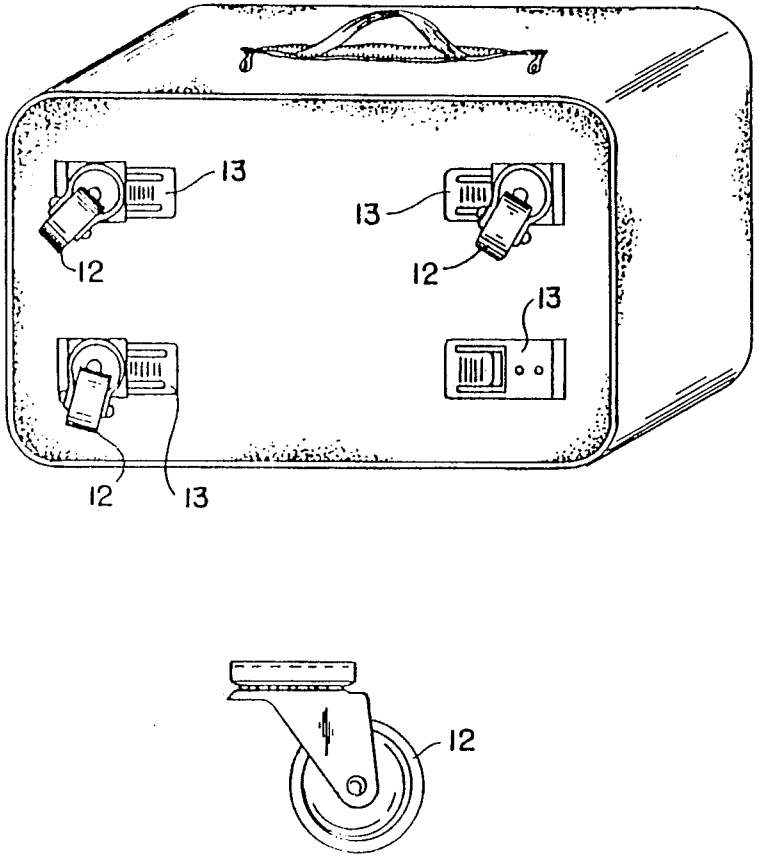
FIG. 5 is a bottom view of the case.

Alternately, the luggage may be carried by a handle 16 in the form of a flexible strap, which is contained in a pocket 18 on one side of case 10 and having a zipper 20. The wheels 12, as shown in FIG. 5, are mounted on bases 13 and they may be removed, if so desired, when the luggage is carried by handle 16.

Figure 4:
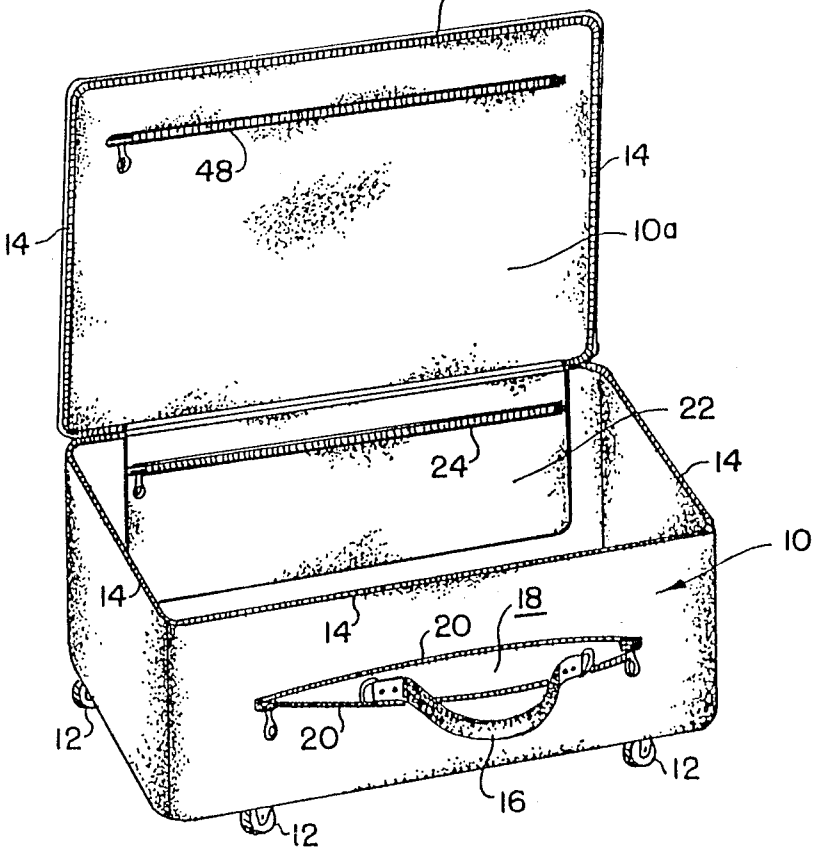
FIG. 4 is a perspective representation of the case, with its cover in an open position.
Figure 3:
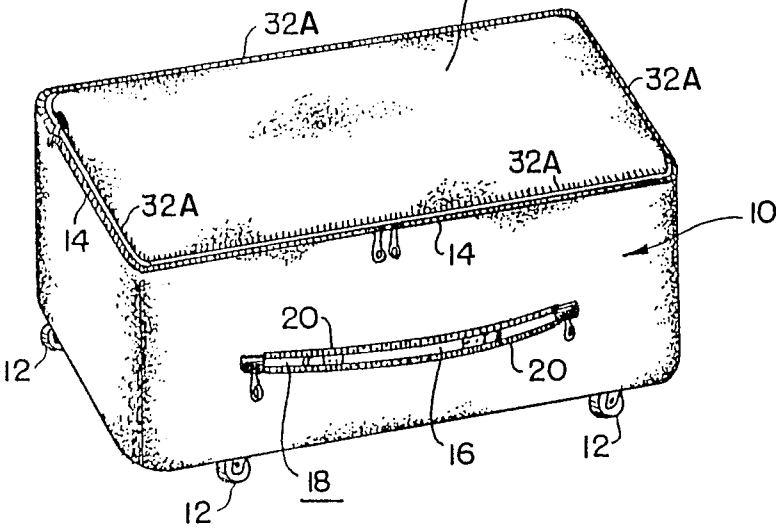
FIG. 3 is a perspective representation of the case, with its cover in a closed position.

Case 10 has a hinged cover **10*a*, which is shown in its closed position in FIG. 3, and in its open position in FIG. 4. The cover 10*a* is held closed by a zipper 14. The case may include an inner compartment 22, as shown in FIG. 4, which is closed by a zipper 24**.

Figure 1:
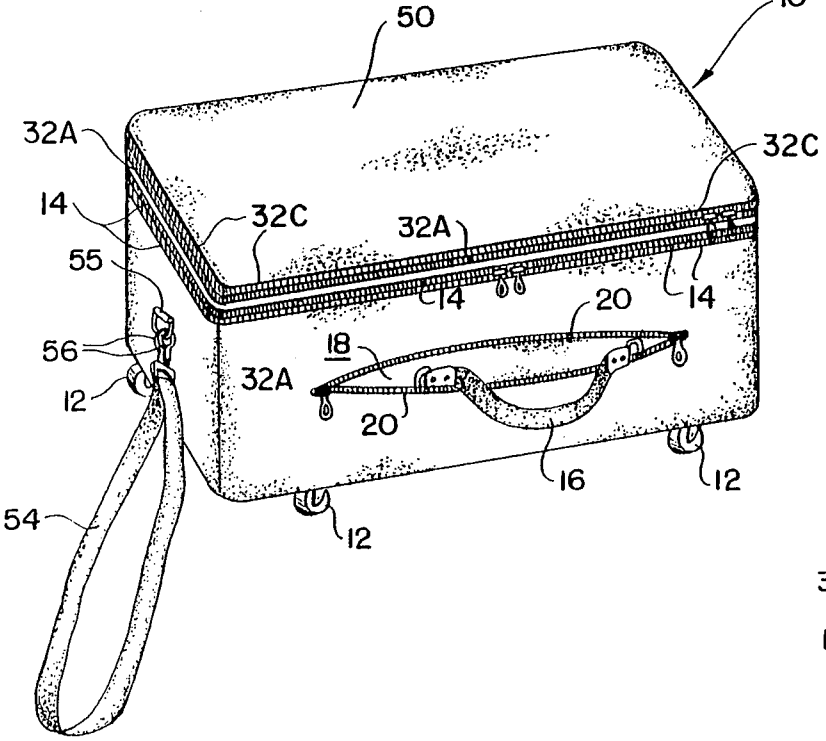
FIG. 1 is a perspective representation showing the expandable luggage of the invention, in one of its embodiments, where only the case is used and the collapsible bag is stowed in a pocket on the top of the case.
Figure 6:
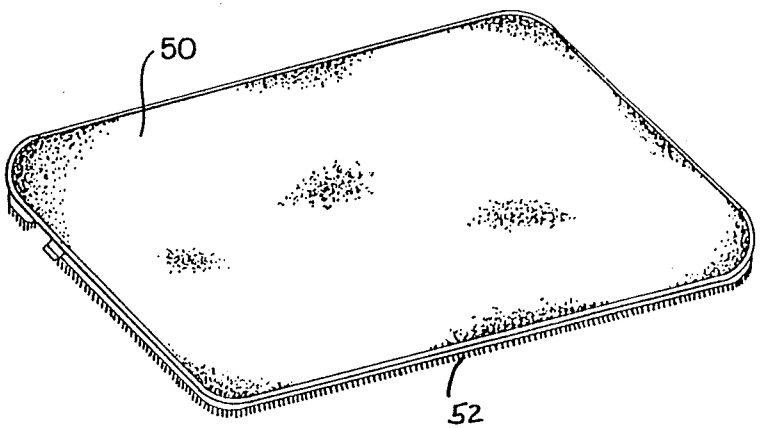
FIG. 6 is a bottom view of a panel which is zippered to the top of the case to form a pocket for the collapsible bag when the bag is not in use.

The expandable luggage of the invention also includes a collapsible bag 30 (FIG. 2) which is attached to the cover **10*a* of the case by a zipper 32A, 32B. A panel 50 (FIG. 6) is provided, and the panel is zippered to zipper section 32A of the cover 10*a* by means of a zipper section 32C, as shown in FIG. 1. Panel 50 may serve to provide a storage pocket for the collapsible bag 30 when the bag is not in use. The collapsible bag 30** may, for example, be formed of an appropriate fabric material.

As best shown in FIG. 2, the top of the collapsible bag 30 has a zipper 34 to provide access to the interior of the bag. Two handles 36 and 38, in the form of flexible straps, are attached to the upper portion of the collapsible bag 30 on opposite sides of zipper 34. Handles 36 and 38 may be held together by appropriate Velcro flaps **40*a*, 40*b*. The collapsible bag 30 may also be equipped with a shoulder strap 42. An additional storage pocket 44 may be attached to the side of the bag, having a zipper 46. A further storage pocket may be provided on the inside of cover 10A, having a zipper 48 (FIG. 4**).

When the bag 30 is in use, as shown in FIG. 2, the hand luggage may be carried, or wheeled on wheels 12. When th collapsible bag 30 is stowed under cover 50, and is not in use, the luggage may be pulled on wheels 12 by the straps 54. Alternately, the wheels 12 may be removed, and the handle strap 16 pulled out of its compartment 18 so that the luggage may be conveniently carried.

The invention provides, therefore, improved expandable luggage which is composed of a case forming a first compartment and which may be expanded to include a second compartment in the form of a collapsible bag when so desired.

While a particular embodiment of the invention has been shown and described, modifications may be made. It is intended in the claims to cover all modifications which come within the true spirit and scope of the invention.

I claim:

1. Expandable luggage comprising: a case having sides and a bottom and an open top; a cover for said open top of said case hinged to the upper edge of one of the sides; a collapsible bag having a bottom; zipper means extending around the perimeter of said cover and around the perimeter of said bottom of said collapsible bag for removably mounting said collapsible bag on the cover of said case with the case being suspended from the collapsible bag; handle means attached to the upper portion of said collapsible bag for carrying said collapsible bag when the collapsible bag is separated from the case, and for carrying the collapsible bag and the case when the case is suspended from the bottom of said collapsible bag; a plurality of wheels mounted on the bottom of said case to permit the case and collapsible bag to be rolled along a supporting surface when the collapsible bag is mounted on top of said case; and handle means attached to one side of said case for carrying said case when said collapsible bag is not in use.

2. The expandable luggage defined in claim 1, and which includes a panel; and further zipper means extending around the perimeter of said panel and the perimeter of the cover for removably attaching said panel to said case to enable said panel to form a pocket for said collapsible bag when the collapsible bag is not in use.

3. The expandable luggage defined in claim 1, in which said handle means comprises a flexible strap attached to one side of said case, and in which said case includes a pocket in said one side ofsaid case for containing said strap when said handle means is not in use.

4. The exapndable luggage defined in claim 1, and which includes a zipper attached to the upper portion of said collapsible bag to provide access to the interior of said collapsible bag, and in which said handle means attached to the upper portion of said collapsible bag comprises a pair of flexible straps respectively attached to the upper portion of said bag on opposite sides of said zipper.

5. The expandable luggage defined in claim 1, and which includes further zipper means extending partially around the perimeter of said cover and partially around the upper edges of the sides of said case to form a closure for said cover.

6. The expandable luggage defined in claim 1, in which said handle means attached to the upper portion of said collapsible bag is in the form of a flexible shoulder strap.

7. The expandable luggage defined in claim 1, and which said case has a generally rectangular shape.

8. The expandable luggage defined in claim 1, and which includes a strap attached to one of the sides of said case for pulling the case and collapsible bag along the supporting surface when the collapsible bag is mounted on the case.

* * * * *